United States Patent [19]

Halliburton

[11] Patent Number: 4,598,910

[45] Date of Patent: Jul. 8, 1986

[54] SURFACE BALL GAME APPARATUS

[75] Inventor: Ronald D. Halliburton, Delray Beach, Fla.

[73] Assignee: Arcade Engineering, Inc., Deerfield Beach, Fla.

[21] Appl. No.: 720,253

[22] Filed: Apr. 5, 1985

[51] Int. Cl.[4] ..... A63F 7/02; A63F 7/30

[52] U.S. Cl. ..... 273/119 A; 273/127 D; 273/119 B; 273/129 V

[58] Field of Search ..... 273/119 B, 119 R, 127 R, 273/129 V, 129 W, 127 D, 119 A

[56] References Cited

U.S. PATENT DOCUMENTS

| | | | |
|---|---|---|---|
| 2,582,844 | 8/1949 | Mourfield | 273/119 B |
| 4,046,380 | 9/1977 | Goldfarb et al. | 273/119 R |
| 4,244,573 | 1/1981 | Breslow et al. | 273/119 R |
| 4,244,574 | 1/1981 | Milner et al. | 273/121 A |
| 4,508,343 | 4/1985 | Peters et al. | 273/127 R |

FOREIGN PATENT DOCUMENTS

| | | | |
|---|---|---|---|
| 2345558 | 3/1975 | Fed. Rep. of Germany | 273/119 A |

*Primary Examiner*—Richard C. Pinkham
*Assistant Examiner*—Gary Jackson
*Attorney, Agent, or Firm*—Oltman and Flynn

[57] ABSTRACT

A ball game apparatus having a playing surface in the shape of an inverted cone surrounded by an upstanding cylindrical wall. An air blower circulates game balls continuously along the circular periphery of the playing surface at the inside of this wall. A ball striker is selectively adjustable along this wall and it has a pivoted striker arm which can be actuated from a retracted position on the outside of the wall to a ball-deflecting position on the inside in the path of game balls along the periphery of the playing surface. Pivoted targets are located in front of the air blower on the opposite of the apex of the playing surface from the striker.

13 Claims, 6 Drawing Figures

FIG. 1
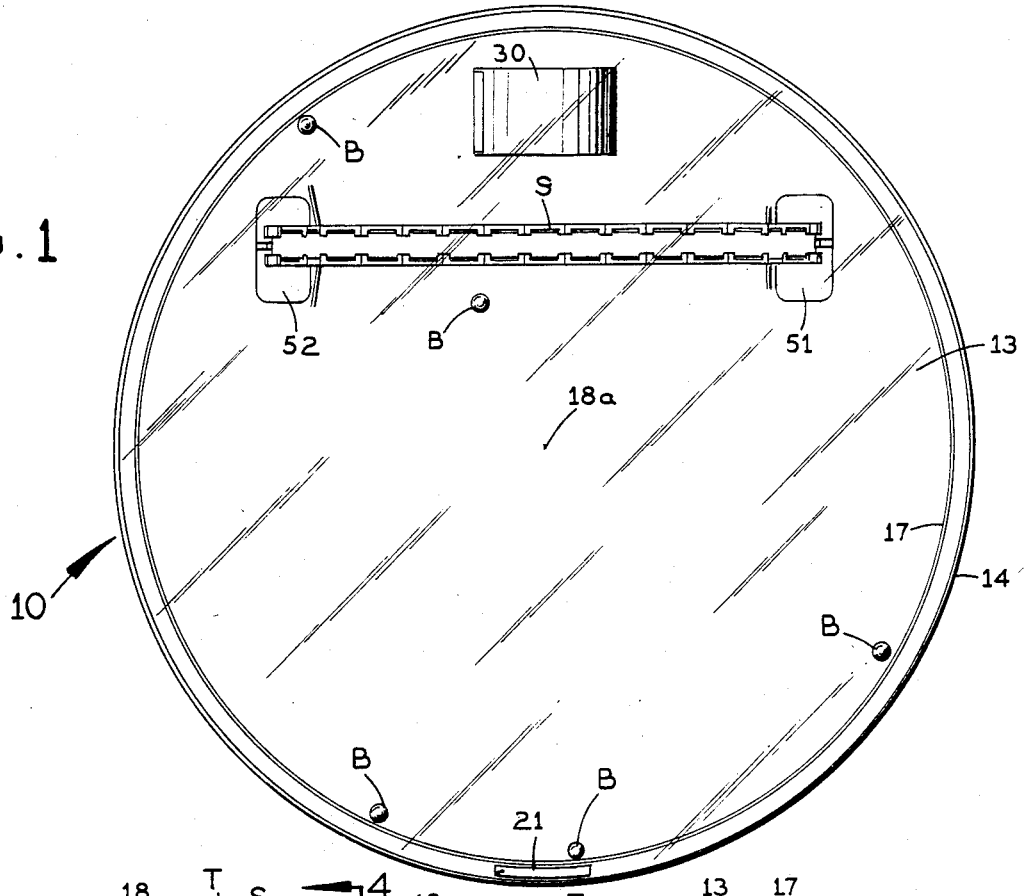
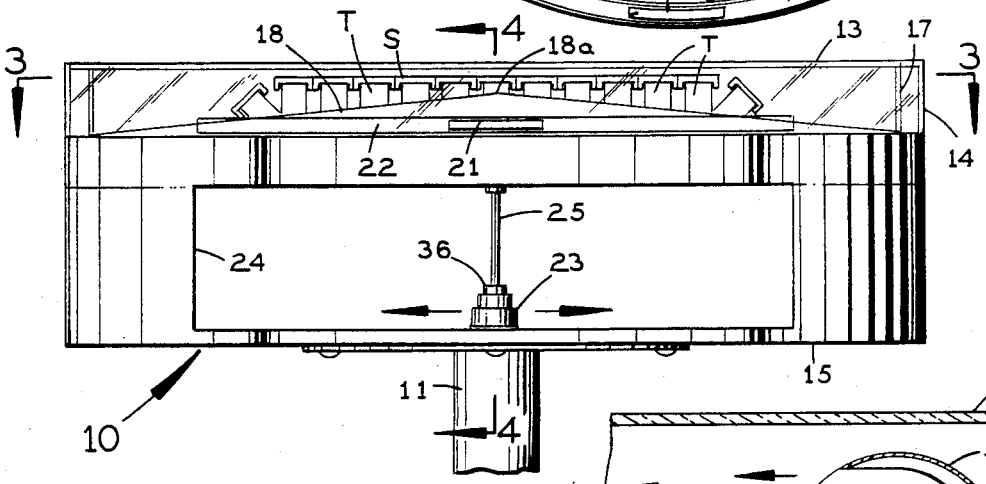
FIG. 2
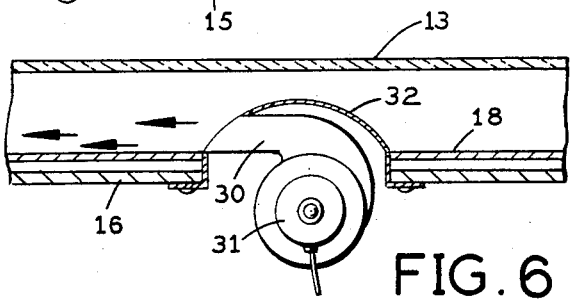
FIG. 6
FIG. 5
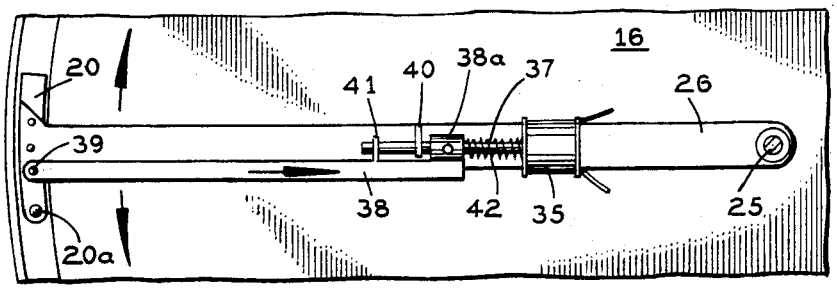

FIG. 3
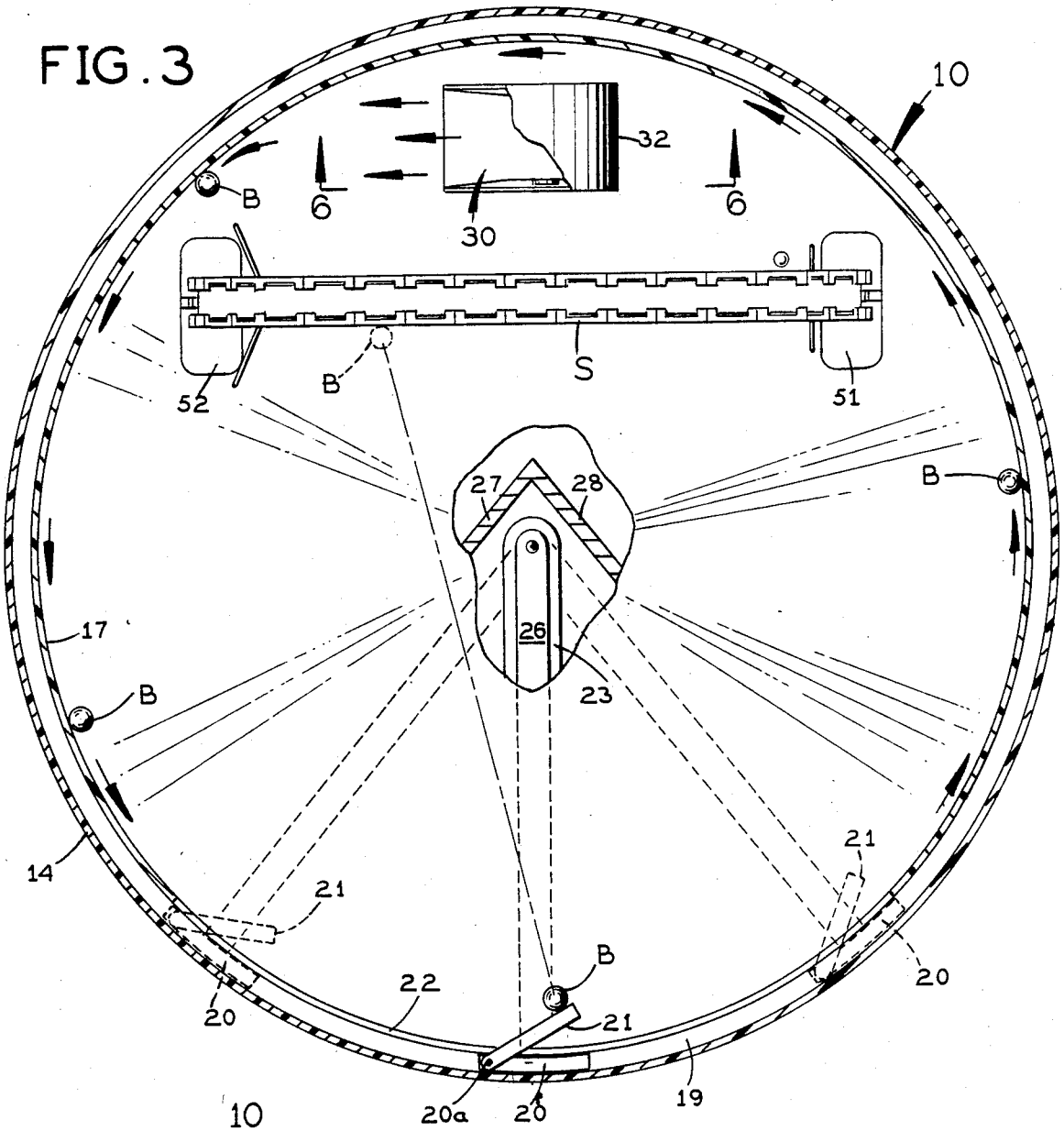
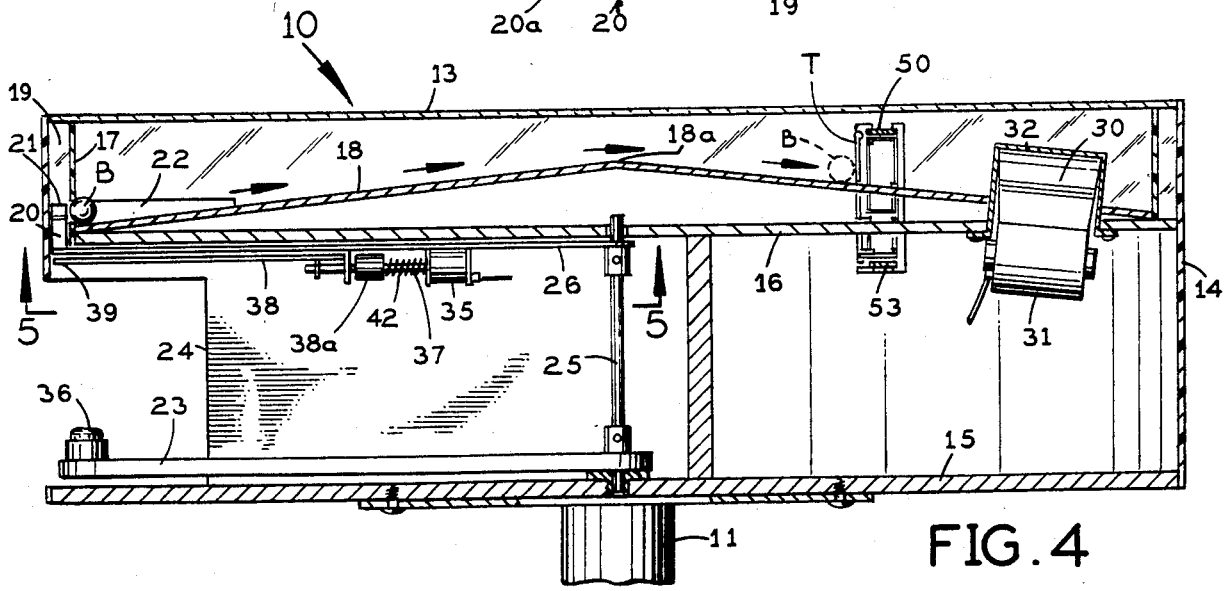
FIG. 4

SURFACE BALL GAME APPARATUS

SUMMARY OF THE INVENTION

This invention relates to a game apparatus in which a player directs a game ball across a playing surface toward a target.

In accordance with a presently preferred embodiment, this game apparatus has a conical playing surface having the apex of the cone as the high point. One or more game balls are blown continuously along the periphery of this playing surface by an air blower. A ball striker or deflector is selectively movable pivotally from a retracted position, in which it is out of the way of the game balls rolling along the periphery of the playing surface, to a ball-deflecting position, in which it is momentarily the path of the next game ball to arrive, deflecting that game ball to roll across the conical playing surface toward a target. The ball striker may also be moved by the player circumferentially along the periphery of the playing surface as one more selective control factor which determines how the ball will be directed across the playing surface toward a target. Preferably, a series of pivotally suspended targets are positioned in succession across the playing surface on the opposite side of its high point from the ball striker and in front of the air blower to shield it.

A principal object of this invention is to provide a novel surface ball game apparatus which tests a player's skill, particularly the eye and hand coordination.

A principal object of this invention is to provide such a game apparatus having a conical playing surface along whose periphery one or more game balls roll continuously until struck by a ball striker whose operation and position along the periphery of the playing surface are under a player's control.

Further objects and advantages of this invention will be apparent from the following detailed description of a presently preferred embodiment, which is illustrated schematically in the accompanying drawings.

DESCRIPTION OF THE DRAWINGS

FIG. 1 is a top plan view of the present game apparatus;

FIG. 2 is a front elevation of the apparatus;

FIG. 3 is a horizontal cross-section taken along the line 3—3 in FIG. 2 and looking down on the playing surface, part of which is broken away to reveal parts underneath;

FIG. 4 is a vertical cross-section taken along the line 4—4 in FIG. 2;

FIG. 5 is a fragmentary view taken along the line 5—5 in FIG. 4; and FIG. 6 is a fragmentary cross-section taken along the line 6—6 in FIG. 3.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

The present game apparatus has a circular housing 10 (FIG. 2) on top of a vertical post 11 which extends up from a base (not shown) resting on the floor. The housing has a rigid cylindrical side wall 14 extending down to a rigid horizontal bottom wall 15 inside the side wall 14 at its lower end. Referring to FIG. 4, about one-third of the way down along its side wall 14 the housing presents a horizontal dividing wall 16. A cylindrical inner wall 17 extends vertically between dividing wall 16 and the top cover 13 a short distance inward from the housing side wall 14. Walls 14 and 17 are concentric and both are transparent, preferably. The playing surface of the game apparatus is the top face of a rigid panel 18 in the shape of a shallow, inverted cone located inside the cylindrical inner wall 17 immediately above the horizontal dividing wall 16. The apex of the cone **18*a* (FIG. 4), which is the high point of the playing surface, is at the conjoint axis of housing walls 14 and 17, directly below the center of the circular top cover 13**.

If desired, the playing surface panel 18 could be of convex rounded curvature on the top, instead of being conical, preferably with its high point at the center.

Referring to FIGS. 3 and 4, for somewhat less than 90 degrees of the circumference of the housing side wall 14, the space between this wall and the cylindrical inner wall 17 defines an arcuate guideway 19 for the arcuate base 20 of a ball striker or deflector which has a striker arm 21 pivotally mounted on the base 20 at **20*a* and normally aligned vertically with the base. The opposite limits of movement of base 20 along the housing guideway 19 are shown in phantom in FIG. 3. The inner wall 17 of the housing is formed with an arcuate, horizontally elongated slot 22 (FIGS. 2, 3 and 4) located just above the playing surface at the periphery of the conical panel 18 and at the same level as the striker arm 21. A player may actuate the striker arm to pivot momentarily from its normal, retracted position outside the inner wall 17 to an inwardly displaced position, as shown in full lines in FIG. 3, in which it extends through the slot 22 past the inner wall 17 and in the path of a game ball B rolling along the periphery of the conical panel 18 (which is the low point of the playing surface) inside the inner housing wall 17. Consequently, the ball will strike the arm 21 and be deflected by it across the playing surface in a direction determined by the velocity of the ball just before striking the arm, the circumferential position of the striker arm along the periphery of the playing surface, and the timing of the inward actuation of the striker arm 21** to strike the ball.

The circumferential position of the striker arm 21 and its base 20 is determined by an elongated, horizontal, pivoted handle 23 (FIG. 4) which is accessible at a relatively large side opening 24 in the housing side wall 14 (FIGS. 2 and 4) below the horizontal dividing wall 16 of the housing. Handle 23 is located just above the bottom wall 15 of the housing. It extends horizontally out from a vertical shaft 25, which is rotatably supported by the housing walls 15 and 16 in vertical alignment with the central apex **18*a* of the conical playing surface. Just below wall 16, shaft 25 carries a horizontal arm 26 on whose outer end is mounted the base 20 of the ball striker. Both the handle 23 and the arm 26 are rigidly fastened to shaft 25, so that the ball striker will follow the movement of handle 23 circumferentially of the housing. The housing has internal vertical walls 27 and 28 (FIG. 3) which extend between the housing walls 15 and 16 and meet on the opposite side of shaft 25 from the side wall opening 24. These walls 27 and 28 provide limit stops for the handle 23** in either direction.

On the opposite side of the playing surface from the arcuate slot 22 is an air blower 30 driven by a small electric motor 31 (FIGS. 4 and 6). The blower is covered by a canopy piece 32 which projects up through aligned openings in the horizontal dividing wall 16 and the playing surface panel 18. As shown in FIGS. 1 and 3, this canopy is spaced inward from the cylindrical inner wall 17 of the housing enough to permit playing balls B to pass between them but close enough that the air comes out of the blower almost parallel to the inner wall 17 and creates a relatively non-turbulent flow of air circumferentially along the periphery of the playing surface just inside the inner wall 17. This circumferential stream of air causes the game balls to roll along the periphery of the playing surface continuously until struck by the striker arm 21 when it is actuated by a player. In one practical embodiment, the speed of each game ball is such that is completes a revolution along the periphery of the conical playing surface in about 1.2 seconds.

The striker arm 21 is actuated momentarily by a solenoid 35 (FIGS. 4 and 5) attached to the bottom of arm 26 and under the control of a pushbutton-operated switch 36 (FIG. 4) on the outer end of handle 23. When solenoid 35 is energized by closing switch 36, it pulls in a horizontally slidable plunger 37 which extends from the solenoid toward the striker arm 21 and its base 20. An actuator arm 38 has a sleeve 38*a* on its inner end (FIG. 5) which is fastened to the solenoid plunger 37. The outer end of actuator arm 38 is pivotally coupled at 39 to the ball striker arm 21 at a location spaced from the pivotal connection at 20*a* of the striker arm 21 to its base 20. A pair of guides 40 and 41 on the bottom of arm 26 slidably receive the solenoid plunger 37. A coil spring 42, which is under compression between the solenoid coil 35 and the sleeve 38*a* on the inner end of actuator arm 38, biases the solenoid plunger 37 out from solenoid 35 so that striker arm 21 normally will be vertically aligned with its base 20.

When a player operates the pushbutton switch 36 on the outer end of handle 23, it momentarily completes an energization circuit for solenoid coil 35, which pulls in its plunger 37 (to the right in FIG. 5). This movement of the solenoid plunger is imparted to the arm 38 which pulls on the striker arm 21, causing it to pivot at 20*a* on its base 20 to project at an acute angle inward past the inner wall 17 and in the path of the next game ball B rolling counterclockwise in FIG. 3 along the periphery of the playing surface panel 18 (which is its low point). Even if the push button switch 36 is held closed, the solenoid remains energized only long enough to move the striker arm 21 in to its ball-striking position and then the spring 37 returns it to the retracted position. In one practical embodment, the striker arm moves in and out in about 0.015 seconds.

The game assembly has one or more targets located just above the conical playing surface on the opposite side of its apex 18*a* from the ball striker 21. In the illustrated embodiment there is an assembly of pivotally suspended targets T (FIG. 2) carried individually by respective sliders S which extend end-to-end in front of the blower 30. The sliders are displaced intermittently, such as from right to left in FIGS. 1, 2 and 3, along a rigid endless guide track having a horizontally elongated top segment above the playing surface, shown at 50 in FIG. 4, and rounded end segments at its opposite ends extending down through respective openings 51 and 52 (FIGS. 1 and 3) in conical panel 18 and the dividing wall 16 below, and a lower, horizontally elongated, return segment 53 extending between these rounded end segments below the dividing wall 16 of the housing.

If desired, the target assembly could consist of pivoted targets having a fixed location, or pivoted targets on an endless conveyor, or one or more targets, fixed or movable, which are not pivoted.

Preferably, as shown, the target assembly extends across the playing surface far enough to shield the blower canopy 32 from being struck directly by a game ball B which has struck the ball striker arm 21. The game ball will strike one of the targets T first and will have most of its momentum absorbed in doing so, as well as undergoing a change in direction because of striking the target. Therefore, any game ball which does strike the blower canopy 32 after being deflected by the ball deflector 21 and striking a target T will strike the blower canopy with not enough force to damage it.

OPERATION

In the operation of this game apparatus, one or more game balls B are put into play, one at a time, in the circumferential path of the air from blower 30 along the periphery of the conical panel 18 just inside the inner side wall 17 of the housing. The game balls B arrive at different times at the ball striker 20, 21.

A player grasps the outer end of handle 23 to move it along the circumferential opening 24 in the housing side wall 14, either continuously or to a selected position. The base 20 of the ball striker follows this movement of handle 23.

The player may actuate the switch pushbutton 36 at any time to energize the solenoid 35 and cause the pivoted striker arm 21 to move inward throughout slot 22 past the inner side wall 17 of the housing into the circumferential path of the next game ball B to arrive at the striker.

When a game ball B hits the striker arm 21, it will be deflected across the conical top surface of panel 18 and will strike one of the targets T in the target assembly. Eventually, that ball will be caught again in the stream of pressurized air from the air blower 30 and will resume rolling around the inside of the inner side wall 17 along the periphery of the conical playing surface.

After each actuation the striker arm 21 is retracted very quickly so that the player can actuate it again to strike the next ball to arrive.

I claim:

1. In a surface ball game apparatus comprising:

means defining an upwardly-facing playing surface with a rounded periphery and a wall extending up from said playing surface along its rounded periphery;

air blower means for propelling one or more game balls continuously along said rounded periphery of the playing surface at the inside of said wall;

a ball striker selectively movable between (a) a retracted position out of the game ball path along the periphery of the playing surface, and (b) a ball-deflecting position in which it extends into the game ball path for deflecting a game ball rolling along the rounded periphery of the playing surface;

and means defining at least one target for a game ball deflected across the playing surface by the ball striker;

the improvement which comprises:

means for selectively adjusting the position of said striker along said rounded periphery of the playing surface.

2. A game apparatus according to claim 1 wherein: said ball striker is pivotally movable between said retracted and ball-deflecting positions.

3. In a surface ball game apparatus comprising:

means defining an upwardly-facing playing surface with a rounded periphery and a wall extending up from said playing surface along its rounded periphery;

air blower means for propelling one or more game balls continuously along said rounded periphery of the playing surface at the inside of said wall;

a ball striker selectively movable between (a) a retracted position out of the game ball path along the periphery of the playing surface, and (b) a ball-deflecting position in which it extends into the game ball path for deflecting a game ball rolling along the rounded periphery of the playing surface;

and means defining at least one target for a game ball deflected across the playing surface by the ball striker;

said playing surface throughout its extent being inclined upward from its rounded periphery toward the middle of the playing surface;

said target defining means being on the opposite side of the middle of the playing surface from the ball striker;

said target defining means comprising a plurality of targets located above said playing surface and positioned in succession across said playing surface;

said ball striker being pivotally movable between said retracted and ball-deflecting positions;

and further comprising:

means for selectively adjusting the position of said striker along said rounded periphery of the playing surface.

4. A game apparatus according to claim 3 wherein: said playing surface is an inverted cone having its apex located centrally of its rounded periphery.

5. In a surface ball game apparatus comprising:

means defining an upwardly-facing playing surface with a rounded periphery and a wall extending up from said playing surface along its rounded periphery;

air blower means for propelling one or more game balls continuously along said rounded periphery of the playing surface at the inside of said wall;

a ball striker selectively movable between (a) a retracted position out of the game ball path along the periphery of the playing surface, and (b) a ball-deflecting position in which it extends into the game ball path for deflecting a game ball rolling along the rounded periphery of the playing surface;

means defining at least one target for a game ball deflected across the playing surface by the ball striker;

said playing surface being an inverted cone having its apex located centrally of its rounded periphery:

and means for selectively adjusting the position of said striker along said rounded periphery of the playing surface.

6. A game apparatus according to claim 5 wherein: said target defining means is on the opposite side of said apex of the playing surface from said striker.

7. A surface ball game apparatus comprising:

means defining an upwardly-facing playing surface with a rounded periphery and a wall extending up from said playing surface along its rounded periphery;

an air blower having a canopy extending up from said playing surface and operative to blow air across the top of said playing surface along the inside of said wall to propel game balls along said rounded periphery of the playing surface, said canopy being spaced from said wall far enough to permit a game ball to roll between them along said rounded periphery of the playing surface;

ball striker means spaced from said air blower along the rounded periphery of the playing surface for selectively deflecting a ball across the playing surface;

and target means positioned with respect to said playing surface away from said ball deflector means to be struck by a ball deflected by said deflector means.

8. A game apparatus according to claim 7 wherein: said target means is above said playing surface between said ball deflector means and said canopy of the air blower.

9. A game apparatus according to claim 8 and further comprising:

means for selectively adjusting the position of said ball striker means along the rounded periphery of the playing surface.

10. A game apparatus according to claim 9 wherein: said ball striker means comprises a pivoted arm movable from a retracted position outside said rounded periphery of the playing surface to a ball-deflecting position extending inward from said wall across said playing surface.

11. A surface ball game apparatus comprising:

a housing having a panel defining an upwardly-facing playing surface with a circular periphery, a wall extending up from said playing surface along its circular periphery, and a transparent top cover spaced above said panel;

an air blower having a canopy extending up from said panel and below said top cover and operatively arranged to blow air across the top of said playing surface along the inside of said wall to propel game balls along said circular periphery of the playing surface, said canopy of the air blower being spaced inward from said wall far enough to pass a game ball between them, said wall having a circumferential slot therein above the periphery of the playing surface on the opposite side from said air blower;

a ball striker having a base movable along said slot at the outside of said wall and a striker arm pivoted on said base for movement between a retracted position outside said wall and a ball-deflecting position projecting through said slot across the top of said playing surface in the path of a game ball rolling along said circular periphery of the playing surface;

and target means below said top cover overlying said playing surface between said ball striker and said air blower.

12. A game apparatus according to claim 11 and further comprising:

a handle below said playing surface panel operatively connected to said base of the striker to position the latter along said circumferential slot;

a solenoid operatively coupled to said striker arm to move the latter from said retracted position to said ball-deflecting position;

and a pushbutton switch on said handle for momentarily energizing said solenoid.

13. A game apparatus according to claim 12 wherein:

said playing surface is an inverted cone with its apex substantially centered below said top cover;

and said target means and said air blower are on the opposite side of the apex from said ball striker.

* * * * *